US008051574B1

(12) United States Patent
Kronengold et al.

(10) Patent No.: US 8,051,574 B1
(45) Date of Patent: Nov. 8, 2011

(54) THIRD AXIS LEVEL FOR ARCHERY SIGHT

(75) Inventors: David H. Kronengold, Tucson, AZ (US); Hill Joe, Tucson, AZ (US)

(73) Assignee: Precision Shooting Equipment, Inc., Tucson, AZ (US)

( * ) Notice: Subject to any disclaimer, the term of this patent is extended or adjusted under 35 U.S.C. 154(b) by 1 day.

(21) Appl. No.: 12/685,032

(22) Filed: Jan. 11, 2010

Related U.S. Application Data

(60) Provisional application No. 61/247,357, filed on Sep. 30, 2009.

(51) Int. Cl.
*F41G 1/467* (2006.01)

(52) U.S. Cl. ..... 33/265; 124/87

(58) Field of Classification Search ..... 33/265, 33/347, 354, 370, 374–377, 379, 384, 385, 33/389; 124/87
See application file for complete search history.

(56) References Cited

U.S. PATENT DOCUMENTS

| | | | | |
|---|---|---|---|---|
| 3,664,032 | A * | 5/1972 | Tompkins | 33/334 |
| 5,303,479 | A | 4/1994 | Rudovsky | |
| 5,630,279 | A * | 5/1997 | Slates | 33/265 |
| 6,802,129 | B1 * | 10/2004 | Wirth | 33/265 |
| 7,331,112 | B2 | 2/2008 | Gibbs | |
| 7,484,303 | B1 | 2/2009 | Henry | |
| 7,487,594 | B2 | 2/2009 | Labowski | |

* cited by examiner

*Primary Examiner* — Amy Cohen Johnson
(74) *Attorney, Agent, or Firm* — Cahill Glazer PLC

(57) ABSTRACT

A third axis level for an archery sight incorporating a bubble level mounted on an assembly that may be rotated independently about a vertical axis and horizontal axis and wherein adjustment in either axis is independent of the other and both adjustments are independent of any other adjustment of the bow sight or any other accessory that may be mounted on the bow.

10 Claims, 1 Drawing Sheet

THIRD AXIS LEVEL FOR ARCHERY SIGHT

CROSS-REFERENCE TO RELATED APPLICATION

This application is related to and claims priority to a provisional application entitled "THIRD AXIS LEVEL FOR ARCHERY SIGHT" filed Sep. 30, 2009 and assigned Ser. No. 61/247,357.

FIELD OF THE INVENTION

The present invention relates to archery accessories, and more particularly to levels for adjusting archery bow sights.

BACKGROUND OF THE INVENTION

Utilization of bubble levels for archery bows is well known in the art. Many such levels in the prior art are either permanently installed without adjustment capability or semi-permanently installed and limited to adjustment in one axis only. Prior art attempts to correct errors occurring in the sight picture viewed by an archer when aiming uphill or downhill (a third axis rotation of the bow sight) have been imprecise and frequently require complex mechanisms that are cumbersome and complicated.

The third axis adjustment is necessary to compensate for errors in the relationship between the horizontal ground plane, the vertical plane of the bow, and the inclination of the bow as it is being fired.

It is possible for a prior art bubble level to be adjusted so that when the archer sights the bow before firing, the pin sight or other similar sight, accurately depicts where the arrow should strike when it reaches the target. However, if the target is raised above the horizon, or below the horizon, it is possible for the bubble level to falsely indicate that the plane of the bow needs to be canted with respect to horizontal. Under such circumstances, such canting results in an erroneous indication to the archer. When the archer subsequently corrects for what he views as the sight picture, the bow becomes canted with respect to horizontal. The result of such action is the arrow traveling to the right or left of the target since his "corrections" actually result in the arrow's path being directed to one or the other side of the target rather than directly at the target.

SUMMARY OF THE INVENTION

The present invention provides a third axis level that is mounted in the pin guard area of the archery sight and allows adjustment independent of the pin guard and its mount. The arrangement also allows the assembly to be mounted and removed on various archery sighting accessories to permit third axis corrections to be made on any bow system upon which it is mounted. The bubble level incorporated in the third axis level of the present invention is provided with micro-adjustable set screws to allow the level to be precisely moved in small increments in both the horizontal and vertical axis. Set screws securely lock the level when adjustments are completed. The combination of precise movements in two axes is used to confirm the bow being level when tipped forward or backward in the third axis. This capability is important as indicated above to provide correct uphill and downhill shooting conditions.

BRIEF DESCRIPTION OF THE DRAWINGS

The present invention may more readily be described by reference to the accompanying drawings in which.

DETAILED DESCRIPTION OF THE INVENTION

Figure 1:
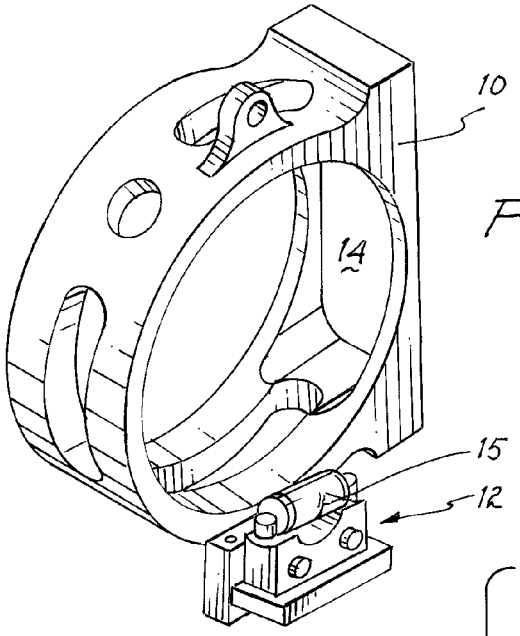
FIG. 1 is a perspective view of an archery sight pin guard for attachment to an archery bow and having a level assembly of the present invention mounted thereon.

Referring to FIG. 1, a sight pin guard 10 is shown to which a level assembly 12, constructed in accordance with the teachings of the present invention, is attached. Modern compound bows typically utilize sight pins that comprise several horizontally extending support rods or tubes having a colored or enlarged tip on each of the pins. When the archer draws the bow and aims, the tip of a selected one of the pins may be placed on the target. The choice of the particular pin that is used in the aiming process depends on the archer's estimate of the distance to the target. Thus, a target that is near would typically require aiming using the uppermost pin while a distant target would generally require using one of the lower pins. The selection, use and structure of sight pins is well known and need not be described here. It may, however, be noted that other types of sight accessories may be utilized in combination with the level assembly of the present invention.

Since the pins extend horizontally from the riser of the archery bow, they are subject to damage and breakage from handling or striking objects as the bow is transported by the archer. Accordingly, sight pin guards such as shown at 10 in FIG. 1 are mounted on the riser, or on an accessory to the riser, such that the sight pins extend through an opening 14 provided in the pin guard 10.

As the archer utilizes the sight pins, which extend into the circular guarding structure of the pin guard 10, the level assembly 12 is simultaneously in the view of the archer. The sight picture thus presented to the archer includes the target, the selected sight pin, and bubble level 15 of the level assembly 12.

The level assembly 12 is thus intended to present a view to the archer of the correct inclination of the bow. It is important that the bow be positioned and remain in a vertical plane perpendicular to a horizontal plane, remain perpendicular to the horizontal plane and parallel to a vertical plane when the bow is tipped forwardly or rearwardly during the process of aiming. When the archer aligns a selected one of the sight pins with the target the level then presents an accurate indication of the inclination of the bow. The present invention incorporates adjustment means for calibrating the position of the level, and particularly the bubble portion of the level, so that the proper reading is presented to the archer.

Figure 2:
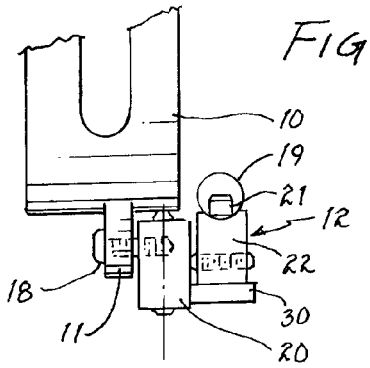
FIG. 2 is a side elevational view of a portion of FIG. 1 showing the attachment of the level assembly to the pin guard.

Referring to FIG. 2, a side elevational view of the portion of FIG. 1 is illustrated showing the attachment of the level assembly 12 to the sight pin guard 10. A tab 11 may be formed integrally with the sight pin guard 10 to provide a convenient means for attaching accessories to the pin guard; the tab is appropriate for attachment to the level assembly 12 through the utilization of a horizontal axis mounting screw 18. The mounting screw 18 passes through the tab 11 into a horizontal plane mounting block 20 which may be formed integrally with a platform member 30. A cradle member 22 is positioned on the platform 30 and provides support for a bubble level 19 secured to the cradle by bubble level attachment screws 21.

Figure 3:
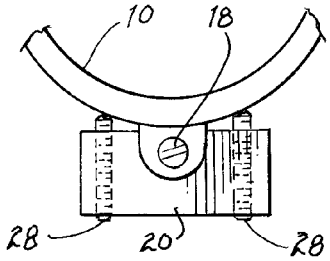
FIG. 3 is a rear elevational view of the level assembly/pin guard shown in FIG. 2.

Referring to FIG. 3, a rear elevational view of the level assembly 12 and pin guard 10 is shown. The mounting block 20 is shown secured to the sight pin guard 10 by the horizontal axis mounting screw 18. The mounting block 20 is rotatable about the axis coincident with the axis of the horizontal axis mounting screw 18 and is locked in position through the utilization of vertical plane set screws 28.

Figure 4:
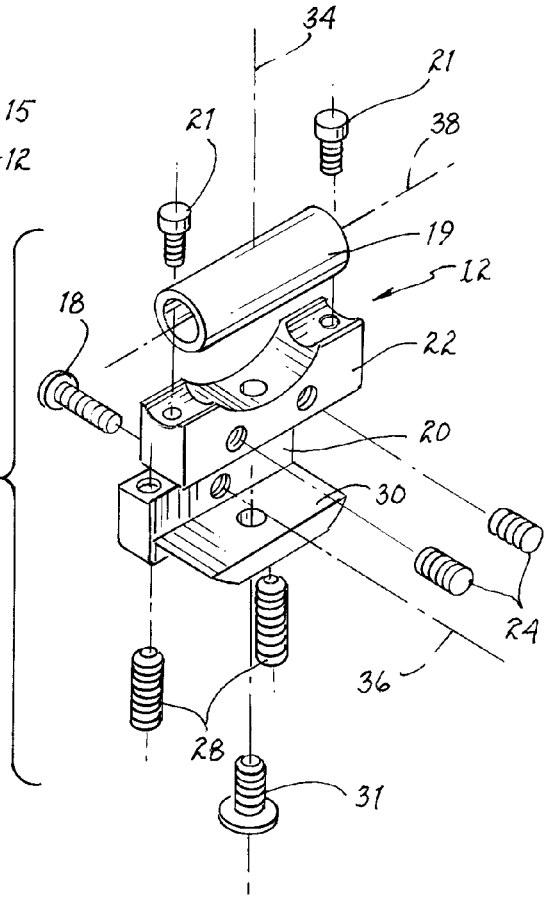
FIG. 4 is an exploded perspective view of the level assembly of the present invention.

Referring to FIG. 4, an exploded perspective view of the level assembly of the present invention is shown. The bubble level 19 is mounted on cradle member 22 and secured by bubble level attachment screws 21. The cradle member is secured to platform 30 by vertical axis mounting screw 31. The cradle 22, and thus the bubble level 19, have limited rotation about the vertical axis 34 and the vertical axis mounting screw 31 and are locked into position by horizontal plane set screws 24. Thus, the bubble level may be rotated about the vertical axis 34 to a chosen position and secured in that position by the set screws 24.

The horizontal plane mounting block 20 is secured to the sight pin guard through the utilization of horizontal axis mounting screw 18. The mounting block is thus permitted limited rotation about the horizontal axis 36 and secured in a desired fixed orientation about that axis by vertical plane set screws 28. Thus, the bubble level 19 may be adjusted about the vertical axis 34 and horizontal axis 36 independently and secured in the respective orientation with regard to those axes by set screws that lock the desired position. Other locking systems may be used to secure the level in its selected position. For example, the vertical and horizontal axes mounting screws may be designed to be tightened to prevent rotation of the mounting block or cradle. However, it is believed the set screw system described above is the preferred manner for locking the level in a selected position. The adjustments that are made in the two axes are independent; that is, the bubble level 19 is adjusted with respect to the orthogonally related vertical axis 34 and horizontal axis 36 and an adjustment along one axis will not affect the other. Adjustment of the bubble level about either axis is independent of the other and both are independent of any adjustment of the bow sight or any other accessory that may be mounted on the bow. Proper adjustments in the positioning of the bubble level about the vertical and horizontal axes thus insures that any rotation of the level assembly 12 about the third axis 38 caused by the rotation of the bow about the third axis when the archer is aiming uphill or downhill will present a correct indication of proper vertical plane positioning of the bow.

Figure 5:
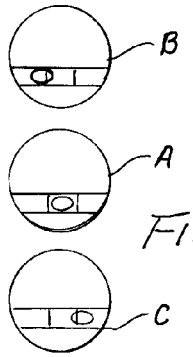
FIG. 5 is an illustration of three hypothetical views of a bubble level as viewed by an archer and useful in the description of the present invention.

FIG. 5 is an illustration of three hypothetical views of a bubble level as viewed by an archer and useful in the description of the present invention. Illustration A is a representative view of an archer holding a bow in a correct vertical plane and viewing a target horizontally distant from the archer and the bow. It may be noted that the bubble level indicates to the archer that the bow is correctly positioned in a vertical plane. Illustration B indicates that the archer has tilted or canted the bow out of the vertical plane to the right and thus requires correction to place the bubble in the center of the level. If the archer is shooting uphill, and the level is not properly oriented with respect to the bow, the position of the bubble will erroneously indicate to the archer that the bow is canted, and when the archer corrects this erroneous representation by tilting his bow out of a vertical plane to the left to thus center the bubble, the bow will actually be tilted, resulting in a misdirected arrow flight path. Illustration C is a representation of the opposite erroneous representation of the sight picture presented to the archer when that same bow is aimed at a target downhill from the archer. The level assembly of the present invention permits the archer to correct for these erroneous sight presentations to the archer by permitting the adjustment of the bubble level about two independent orthogonally related axes. The repositioning of the bubble level using these adjustments to the bubble level about these respective axes can be locked so that the bubble level and the plane of the bow to which it is attached remains perpendicular to the horizontal plane, and is in a vertical plane, and remains perpendicular to the horizontal plane when tipped forward or backward through the third axis 38 thus eliminating sight picture errors when the target is uphill or downhill.

The present invention has been described in terms of selected specific embodiments of the apparatus and method incorporating details to facilitate the understanding of the principles of construction and operation of the invention. Such reference herein to a specific embodiment and details thereof is not intended to limit the scope of the claims appended hereto. It will be apparent to those skilled in the art that modifications may be made in the embodiments chosen for illustration without departing from the spirit and scope of the invention.

What is claimed is:

1. A third axis level for mounting on an archery sight surface of an archery bow to permit level adjustments in a vertical plane and a horizontal plane comprising:

(a) a mounting block rotatably secured to said archery sight surface and rotatable with respect to said archery sight surface about one of a vertical axis and a horizontal axis;

(b) first locking means engaging said mounting block and contacting said sight surface for locking said mounting block in a desired rotational orientation with respect to said one of a vertical axis and horizontal axis;

(c) a cradle member rotatably secured to said mounting block and rotatable about a different one of said vertical axis and said horizontal axis;

(d) second locking means engaging said cradle and contacting said mounting block for locking said cradle in a desired rotational orientation, independent of the desired rotational orientation of said mounting block, with respect to said different one of said vertical axis and horizontal axis; and (e) a level secured to said cradle positioned to be visible by an archer when aiming said bow.

2. The third axis level of claim 1 wherein said first and second locking means comprise first and second set screw means, respectively.

3. The third axis level of claim 1 wherein said first and second locking means comprise first and second pairs of set screws, respectively.

4. A third axis level for mounting on an archery sight surface of an archery bow to permit level adjustments in a vertical plane and a horizontal plane comprising:

(a) a mounting block rotatably secured to said archery sight surface and rotatable with respect to said archery sight surface about a vertical axis;

(b) first locking means engaging said mounting block and contacting said sight surface for locking said mounting block in a desired rotational orientation with respect to said vertical axis;

(c) a cradle member rotatably secured to said mounting block and rotatable about a horizontal axis;

(d) second locking means engaging said cradle and contacting said mounting block for locking said cradle in a desired rotational orientation, independent of the desired rotational orientation of said mounting block, with respect to a horizontal axis; and (e) a level secured to said cradle positioned to be visible by an archer when aiming said bow.

5. The third axis level of claim 4 wherein said first and second locking means comprise first and second set screw means respectively.

6. The third axis level of claim 4 wherein said first and second locking means comprise first and second pairs of set screws respectively.

7. A third axis level for mounting on an archery sight surface of an archery bow to permit level adjustments in a vertical plane and a horizontal plane comprising:

(a) a mounting block rotatably secured to said archery sight surface and rotatable with respect to said archery sight surface about one of a vertical axis and a horizontal axis;

(b) first locking means engaging said mounting block and contacting said sight surface for locking said mounting block in a desired rotational orientation with respect to said one of a vertical axis and horizontal axis;

(c) a platform secured to said mounting block;

(d) a cradle member rotatably secured to said platform and rotatable about a different one of said vertical axis and said horizontal axis;

(e) second locking means engaging said cradle and contacting said mounting block for locking said cradle in a desired rotational orientation, independent of the desired rotational orientation of said mounting block, with respect to said different one of said vertical axis and horizontal axis; and (f) a level secured to said cradle positioned to be visible by an archer when aiming said bow.

8. The third axis level of claim 7 wherein said platform is formed integrally with said mounting block.

9. The third axis level of claim 7 wherein said first and second locking means comprise first and second pairs of set screws respectively.

10. A third axis level for mounting an archery sight surface of an archery bow to permit level adjustments in a vertical plane and a horizontal plane comprising:

(a) a mounting block rotatably secured to said archery sight surface and rotatable with respect to said archery sight surface about a vertical axis;

(b) set screw means threadedly engaging said mounting block and contacting said sight surface for locking said mounting block in a desired rotational orientation with respect to said vertical axis;

(c) a platform, formed integrally with said mounting block;

(d) a cradle member rotatably secured to said platform and rotatable about a horizontal axis;

(e) set screw means threadedly engaging said cradle and contacting said mounting block for locking said cradle in a desired rotational orientation independent of the desired rotational orientation of said mounting block, with respect to a horizontal axis; and (f) a level secured to said cradle positioned to be visible by an archer when aiming said bow.

* * * * *